US010035636B1

(12) United States Patent
Light

(10) Patent No.: US 10,035,636 B1
(45) Date of Patent: Jul. 31, 2018

(54) FRAMED DISPLAY PACKAGING FOR A PRODUCT

(71) Applicant: TESSCO Communications Incorporated, Hunt Valley, MD (US)

(72) Inventor: Jeremy Light, Chicago, IL (US)

(73) Assignee: TESSCO COMMUNICATIONS INCORPORATED, Hunt Valley, MD (US)

( * ) Notice: Subject to any disclaimer, the term of this patent is extended or adjusted under 35 U.S.C. 154(b) by 303 days.

(21) Appl. No.: 14/725,661

(22) Filed: May 29, 2015

(51) Int. Cl.
*B65D 73/00* (2006.01)
*B65D 75/36* (2006.01)
*B65D 75/56* (2006.01)

(52) U.S. Cl.
CPC ..... *B65D 75/367* (2013.01); *B65D 75/566* (2013.01); *B65D 2075/362* (2013.01); *B65D 2575/365* (2013.01)

(58) Field of Classification Search
CPC ..... B65D 73/0092; B65D 73/0057; B65D 75/321; B65D 75/322; B65D 75/323
USPC ..... 206/461–465, 470, 471, 806
See application file for complete search history.

(56) References Cited

U.S. PATENT DOCUMENTS

| | | | | | |
|---|---|---|---|---|---|
| 2,993,587 | A * | 7/1961 | Stone | B65D 5/5026 | 206/471 |
| 3,144,343 | A * | 8/1964 | Fritsche | B65D 75/28 | 206/463 |
| 4,083,451 | A * | 4/1978 | Hair | B29C 65/02 | 206/461 |
| 4,842,143 | A * | 6/1989 | McKee, Sr. | B65D 85/32 | 206/463 |
| 4,848,577 | A * | 7/1989 | Hoffman | B65D 5/5026 | 206/467 |
| 4,903,838 | A * | 2/1990 | Broers | B65D 73/0042 | 206/463 |
| 5,129,527 | A * | 7/1992 | Lataix | B65D 75/22 | 206/461 |
| 6,581,777 | B2 * | 6/2003 | Thibault | B65D 5/5026 | 206/470 |
| 8,616,373 | B2 * | 12/2013 | Hansen | B65D 73/0092 | 206/463 |
| 2008/0029419 | A1 * | 2/2008 | Appelbaum | B65D 73/0057 | 206/463 |
| 2015/0021224 | A1 * | 1/2015 | Vossoughi | B65D 73/0057 | 206/470 |

* cited by examiner

*Primary Examiner* — Luan K Bui
(74) *Attorney, Agent, or Firm* — Shlesinger, Arkwright & Garvey LLP

(57) ABSTRACT

Display packaging for a product comprises first and second clear members disposed on top of each other, the first clear member including a bump-out to provide a cavity to receive the product within the cavity, the first and second clear members including peripheral edge portions; and a frame attached to the peripheral edge portions.

17 Claims, 4 Drawing Sheets

FRAMED DISPLAY PACKAGING FOR A PRODUCT

FIELD OF THE INVENTION

The present invention is generally directed to product packaging for displaying products for viewing by the consumers and in particular, to product packaging wherein the product is framed by the packaging.

SUMMARY OF THE INVENTION

The present invention provides a display packaging for a product, comprising first and second clear members disposed on top of each other, the first clear member including a bump-out to provide a cavity to receive the product within the cavity, the first and second clear members including peripheral edge portions; and a frame attached to the peripheral edge portions.

DETAILED DESCRIPTION OF THE INVENTION

Figure 2:
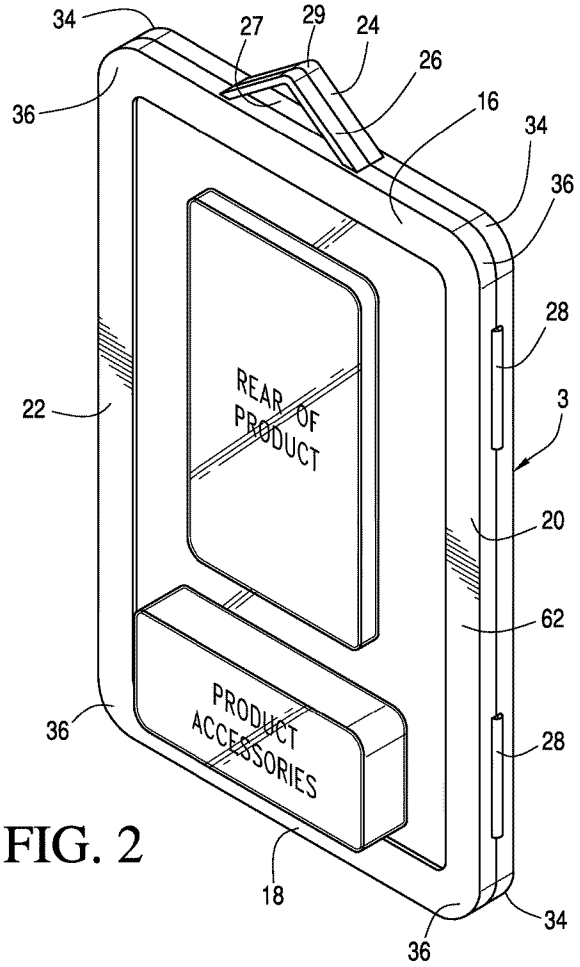
FIG. 2 is rear perspective view of the packaging of FIG. 1.
Figure 1:
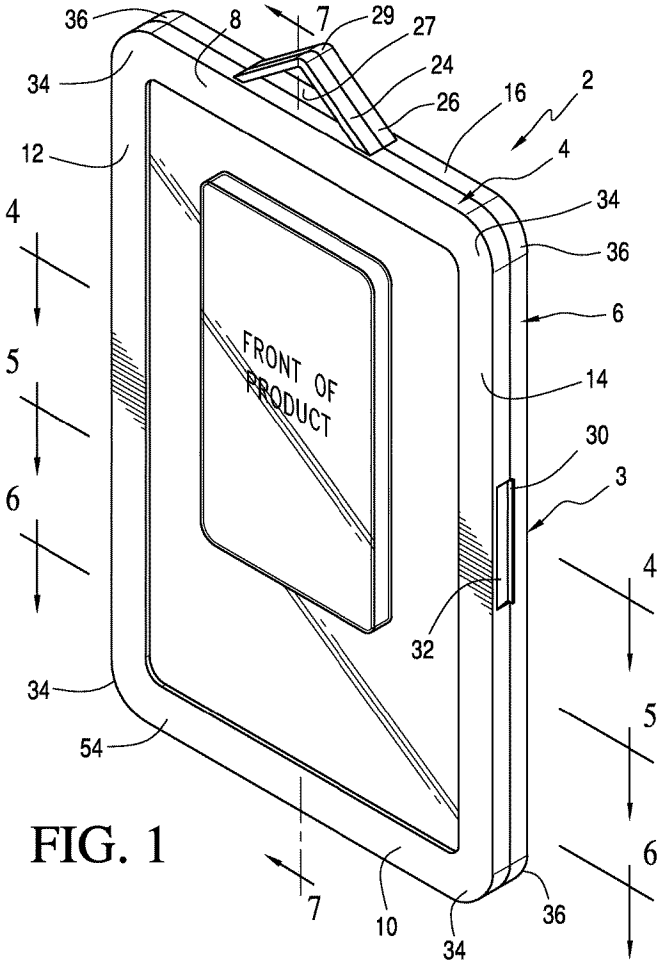
FIG. 1 is front perspective view of a packaging for a product made in accordance with the present invention.

A display packaging 2 for a product is disclosed in FIGS. 1 and 2. The packaging 2 includes a frame 3 that encloses the product as in a picture frame. The frame 3 includes a front frame member 4 and a rear frame member 6 that are configured to mate together in a closed position. When mated together, the front frame member 4 and the rear frame member 6 becomes one unified frame 3. The packaging 2 advantageously frames a product for viewing to attract a consumer's attention.

Although the frame members 4 and 6 are shown as rectangular, the frame members 4 and 6 can be of different shape, such circular, oval, square, etc.

The front frame member 4 includes a top portion 8, a bottom portion 10, a left side portion 12 and a right side portion 14. Similarly, the rear frame member 6 includes a top portion 16, a bottom portion 18, a left side portion 20 and a right side portion 22.

Hang tabs 24 and 26 are attached respectively to the top portions 8 and 16. The hang tabs 24 and 26 are used to hang the packaging 2 from a standard hanging hardware (not shown) commonly used to organize and display products in a retail store. The hang tabs 24 and 26 provide a triangular opening 27 with a peak 29 centered through the center of the package 2. The opening 27 is advantageously large enough for easy insertion of a hanging hardware through the opening. The triangular shape of the opening 27 advantageously self-centers the package 2 after hanging toward the peak 27 as gravity pulls the package 2 downwardly.

Although two hang tabs 24 and 26 are disclosed, one hang tab attached to either frame member 4 or frame member 6 may be sufficient.

Hinge portions 28 attach the front frame member 4 to the rear frame member 8 and allow them to open and close in the manner of opening or closing a book. A latch portion 30 and a cooperating catch portion 32 (see FIG. 11) are provided to keep the frame members 4 and 6 in the closed position.

The front frame member 4 preferably has rounded corners 34. The rear frame member 6 preferably has corresponding rounded corners 36.

The frame members 4 and 6, along with the hinge portions 28, the latch portion 30, the catch portion 32 and hang tabs 24 and 26 are preferably molded as one piece in plastic. The hinge portions 28 are configured to be flexible to provide the hinging function between the frame members 4 and 6. The latch portion 30 and the catch portion 32 have sufficient flexibility for the latch portion 30 to move in and out of the catch portion 30.

Figure 3:
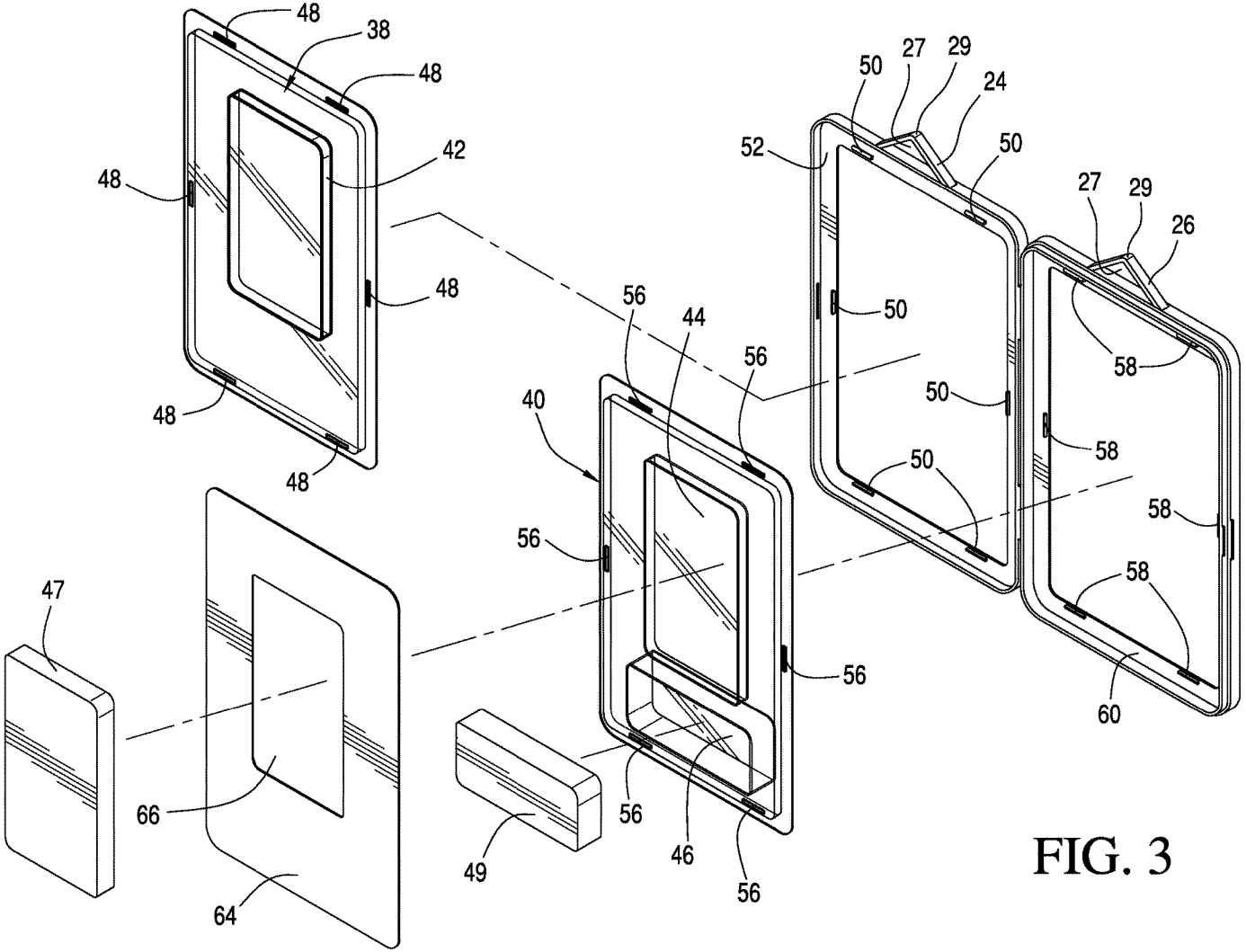
FIG. 3 is assembly view of the packaging of FIG. 1.
Figure 4:
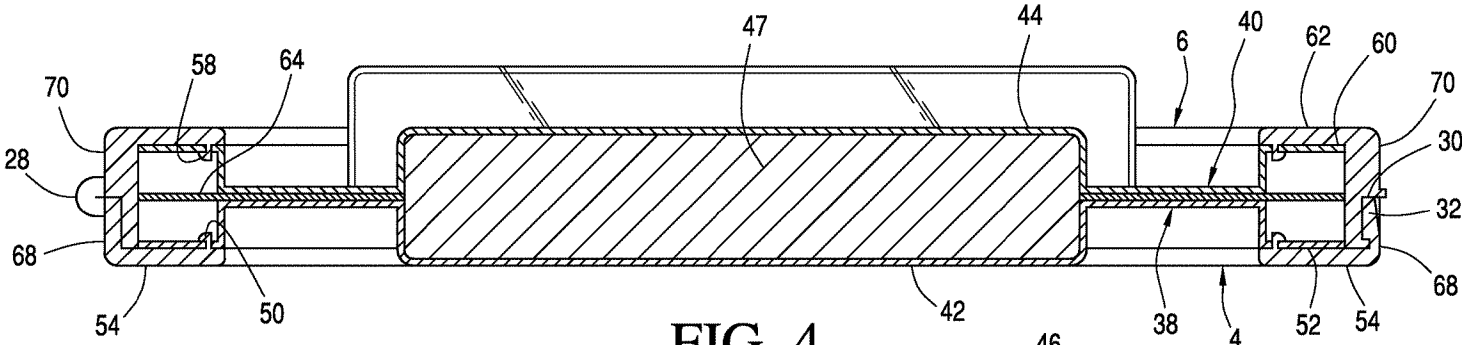
FIG. 4 is cross-sectional view taken along line 4-4 in FIG. 1.
Figure 5:
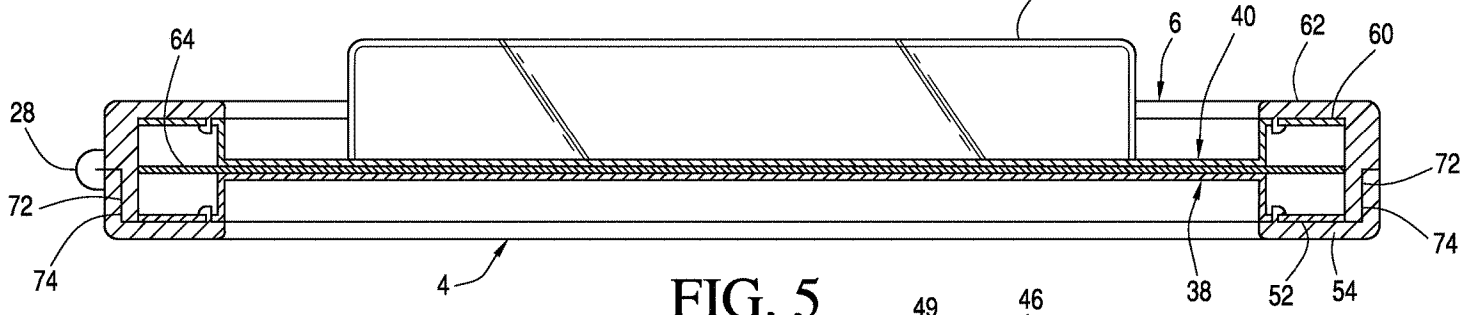
FIG. 5 is cross-sectional view taken along line 5-5 in FIG. 1.
Figure 6:
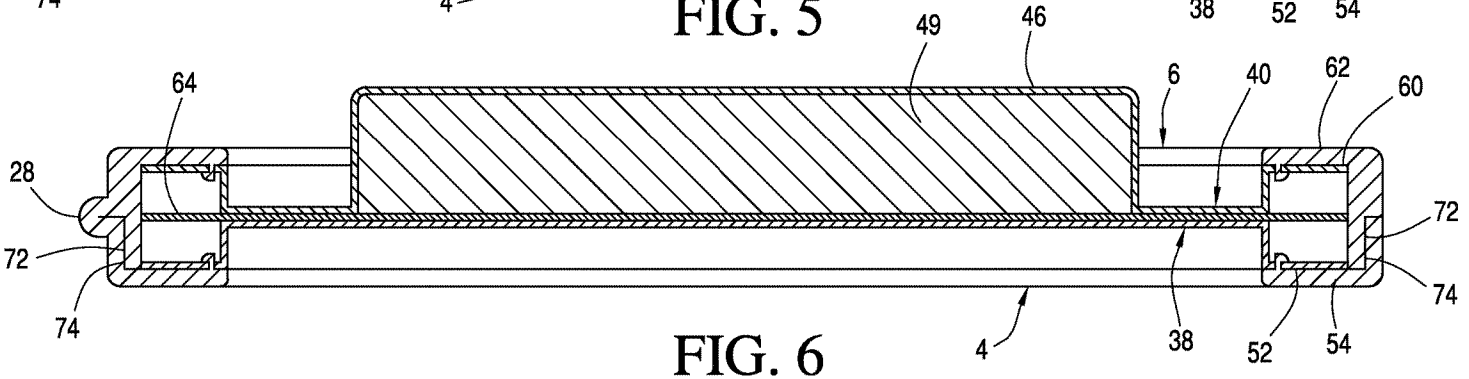
FIG. 6 is cross-sectional view taken along line 6-6 in FIG. 1.

Referring to FIG. 3, clear members 38 and 40 are disposed within the frame members 4 and 6, respectively. The clear members 38 and 40 include bump-outs 42, 44 and 46 that provide enclosed cavities in which products 47 and 49 are placed. The bump-outs 42 and 44 provide complementary cavities to receive the product 47. The bump-out 44 on the clear member 40 may be configured to provide a cavity large enough to completely receive the product 47 so that the bump-out 42 on the clear member 38 may be eliminated.

The clear member 38 has a number of slots 48 along its peripheral edge portion, which are secured to corresponding rib portions 50 on the inner surface 52 of the front wall 54 of the front frame 4. Similarly, the clear member 40 has a number of slots 56 along it peripheral edge portion, which are secured to corresponding rib portions 58 on the inner surface 60 of the rear wall 62 of the front frame 4. The clear members 38 and 40 are removably attached to the respective rib portions 50 and 58.

One of the clear members 38 and 40 may not include a bump-out for the product if the other clear member has sufficiently sized bump-out to accommodate the product.

A card 64 is sandwiched between the clear members 38 and 40. The card 64 is advantageously used for printed information about the products 47 and 49. A cutout 66 corresponding to an outline of the product 47 allows the product 47 to extend through the card 64. The card 64 may have other shapes or configuration depending on the amount of text or graphics needed to describe the products 47 and 49 and attract the consumer's attention.

Referring to FIGS. 4, 5, 6 and 7, the front frame 4 is L-shaped in cross-section across the top portion 8, the bottom portion 10, the left side portion 12 and the right side portion 14. The L-shaped cross-section of the front frame 4 is provided by the front wall 54 and the side wall 68. Similarly, the rear frame 6 is L-shaped in cross-section across the top portion 16, the bottom portion 18, the left side portion 20 and the right side portion 22. The L-shaped cross-section of the rear frame 6 is provided by the rear wall 62 and the side wall 70.

Although individually the front frame 4 and the rear frame 6 is L-shaped in cross-section, it should be understood that when the frames 4 and 6 are joined together as a unified frame 3, a cross-section across the top, bottom, left and right portions of the unified frame 3 is U-shaped, as shown in FIGS. 4-7. This U-shaped cross-section advantageously provides a frame to the product whether viewed from the front or from the rear, as shown in FIGS. 1 and 2.

The edge portion 72 side wall 70 of the rear frame member 6 includes a peripheral recess 74 that receives the corresponding side wall 68 of the front frame member 4 for a flush mating of the front frame member 4 with the rear frame member 6 along the corresponding side walls 68 and 70. The recess 74 advantageously facilitates the mating of the frame members 4 and 6 in the closed position. The recess 74 advantageously guides the side wall 68 of the front frame member 4 into mating engagement with the rear frame member 6 when the frame members 4 and 6 together to a closed position.

Figure 8:
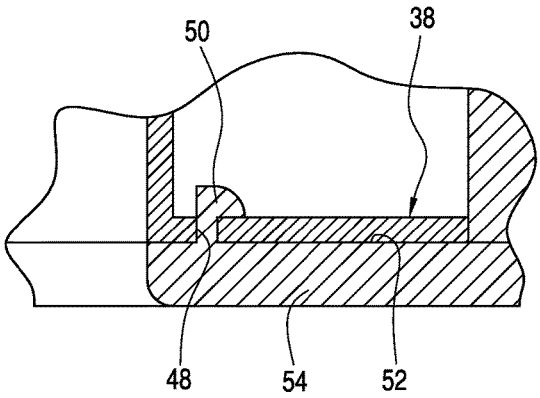
FIG. 8 is an enlarged cross-sectional view of a portion of the packaging taken from the lower right hand corner of FIG. 5.

Referring to FIG. 8, each of the tab portions 50 and 58 is L-shaped in cross-section to advantageously hook the corresponding clear members 38 and 40 in place.

To avoid tampering, a tape may be used to seal the frame members 4 and 6 along the line where the front frame member 4 meets with the rear frame member 6. Once the consumer purchases the product, the package 2 can be easily opened by cutting the tape, releasing the latch 30 from the catch 32 and opening the frame members 4 and 6 about the hinge portions 28. Once the packaging 2 is opened, the products inside become immediately accessible. The difficult task of cutting through a vacuum formed plastic packaging is advantageously eliminated.

The shape, such as rectangular, spherical, etc. and the dimension, such as depth, width and length, of the bump-outs 42, 44 and 46 will depend on the shape and dimension of the particular product that will be placed in the bump-outs. More or less bump-outs than what are shown may be used. For example, the bump-out 46, which is used for an accessory for the product 47, may be eliminated if the product does not require it.

The packaging 2 advantageously presents the products to appear to float in the package. The frame members 4 and 6 act as a picture frame to advantageously present the products to the consumer.

Figure 7:
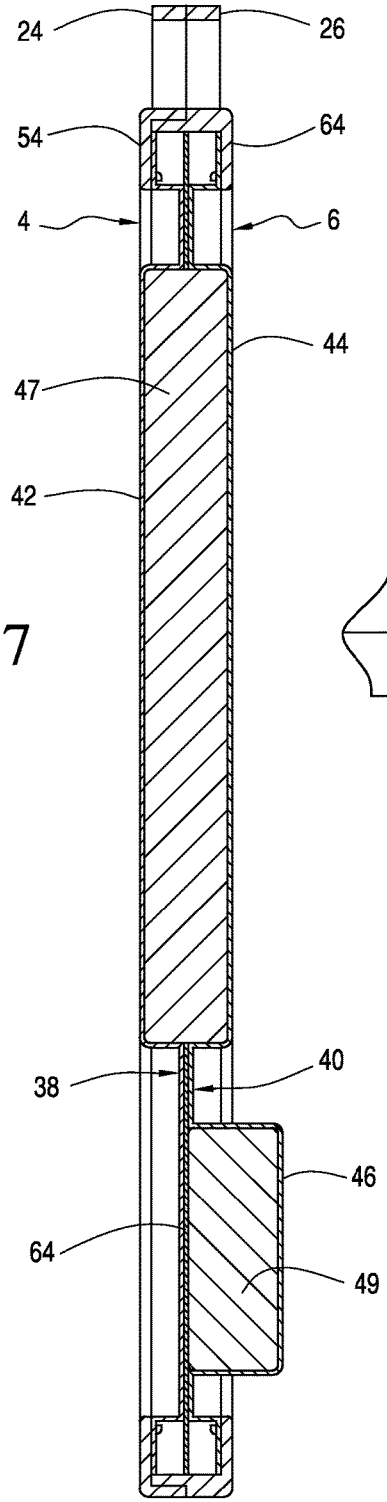
FIG. 7 is cross-sectional view taken along line 7-7 in FIG. 1.

The clear members 38 and 40 are preferably vacuum formed around the products on all sides and allow the consumer to understand the true dimensions of the product without having to take it out of the packaging, as shown in FIG. 7.

The clear members 38 and 40 removably snap into the respective frame members 4 and 6 so that different clear members 38 and 40 for different products may be used in the same frame members 4 and 6. This provides for uniformity in appearance for the different products as they hung from the display wall of a store.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. Display packaging for a product, comprising:

a) first and second clear members disposed overlying each other, said first clear member including a bump-out to provide a cavity to receive the product within said cavity, said first and second clear members including peripheral edge portions;

b) a frame operably attached to said peripheral edge portions, said frame including first and second frame members mated together;

c) said first frame member including a front wall and a side wall, said second frame member including a rear wall and a side wall;

d) said front wall and said rear wall including rib portions;

e) said first and second clear members including slots along their respective peripheral edge portions; and f) said ribs portions are received within respective said slots.

2. Display packaging as in claim 1, wherein a cross-section across a top portion, a bottom portion, a left portion or a right portion of said frame when said first and second frame members are mated together is U-shaped.

3. Display packaging as in claim 1, wherein:

a) said first frame member includes longitudinal top, bottom, left side and right side portions defining a closed figure; and b) said second frame member includes top, bottom, left side and right side portions forming a closed figure.

4. Display packaging as in claim 1, wherein said frame includes rounded corners.

5. Display packaging as in claim 1, wherein:

a) said second frame member includes a latch portion; and b) said first frame member includes a catch portion configured to hold said latch portion when said first and second frame members are mated together.

6. Display packaging as in claim 1, wherein said rib portions are L-shaped.

7. Display packaging as in claim 1, and further comprising a card disposed between said first and second clear members.

8. Display packaging as in claim 7, wherein said side wall of said rear frame member includes a peripheral recess and said side wall of said front frame member is received within said recess when said first and second frame members are mated together.

9. Display packaging as in claim 7, wherein said card includes a cutout corresponding to an outline of the product.

10. Display packaging as in claim 1, and further comprising a hang tab.

11. Display packaging as in claim 10, wherein said hang tab provides a triangular-shaped opening.

12. Display packaging as in claim 3, wherein a cross-section across said top portion, bottom portion, left side portion or right side portion is L-shaped.

13. Display packaging as in claim 1, wherein said frame is rectangular.

14. Display packaging as in claim 1, wherein said first and second clear members include opposed bump-outs to provide complementary cavities to receive another product within said complementary cavities.

15. Display packaging for a product, comprising:

a) first and second clear members disposed overlying each other, said first clear member including a bump-out to provide a cavity to receive the product within said cavity, said first and second clear members including peripheral edge portions;

b) a frame operably attached to said peripheral edge portions, said frame including first and second frame members mated together;

c) said first frame member including a front wall and a side wall, said second frame member including a rear wall and a side wall; and d) said side wall of said rear frame member including a peripheral recess and said side wall of said front frame member is received with said recess when said first and second frame members are mated together.

16. Display packaging as in claim 15, wherein said first and second clear members are removably attached to respective said first and second frame members.

17. Display packaging as in claim 15, wherein:

a) said front wall and said rear wall include rib portions; and b) said first and second clear members include slots along their respective peripheral edge portions; and c) said ribs portions are received within respective said slots.

* * * * *